US007963415B2

(12) United States Patent
Perucci et al.

(10) Patent No.: US 7,963,415 B2
(45) Date of Patent: Jun. 21, 2011

(54) BUILDING DESIGN OF A CONTAINER-DRUM

(75) Inventors: Marcelo Perucci, Louveira (BR); Paulo Francisco Webber, Caxlas do Sul (BR)

(73) Assignees: Linpac Pisani Ltda, Caxias do Sul (BR); Rigesa Cellulose Papel E Embalagens Ltda, Valinhos (BR)

( * ) Notice: Subject to any disclaimer, the term of this patent is extended or adjusted under 35 U.S.C. 154(b) by 898 days.

(21) Appl. No.: 12/150,335

(22) Filed: Nov. 14, 2006

(65) Prior Publication Data

US 2009/0127261 A1 May 21, 2009

(30) Foreign Application Priority Data

Nov. 14, 2005 (BR) ..... 0505874

(51) Int. Cl.
*B65D 45/00* (2006.01)
*B65D 45/32* (2006.01)
*B65D 1/42* (2006.01)

(52) U.S. Cl. ..... 220/320; 220/315; 220/610; 220/645; 220/646; 220/648

(58) Field of Classification Search ..... 220/293, 220/315, 320, 610, 645, 646, 648, 649, 650, 220/784, 788, 916
See application file for complete search history.

(56) References Cited

U.S. PATENT DOCUMENTS

| | | | | |
|---|---|---|---|---|
| 1,686,222 | A * | 10/1928 | Adler | 220/7 |
| 4,421,253 | A * | 12/1983 | Croley | 222/105 |
| 5,361,928 | A * | 11/1994 | Stolzman | 220/378 |
| 5,413,236 | A * | 5/1995 | Kenevan | 220/4.28 |
| 5,899,337 | A * | 5/1999 | Thebeault | 206/600 |
| 2005/0194390 | A1 * | 9/2005 | Savicki et al. | 220/781 |

* cited by examiner

*Primary Examiner* — Anthony Stashick
*Assistant Examiner* — Madison L Wright
(74) *Attorney, Agent, or Firm* — Sughrue Mion, PLLC

(57) ABSTRACT

A building design of container-drum is described that includes a lid (10) positioned at the top and at the base of a container-drum (20) and this lid (10) matches the shape of the container-drum's body (20) and has a surface with a circular projection (101) and an orthogonal projection of the rim (102) around the edge of the container-drum's body (20) and this surface (101) has a lowered hub (103) and concentric guides (104) in order to fit the fastening belts (30) and these concentric guides come off of the central hub (103), having cavities and spoked reinforcements (105) set in between the guides (104) with the lid (10) having rims on the top surface with a beveled region (106).

3 Claims, 7 Drawing Sheets

BUILDING DESIGN OF A CONTAINER-DRUM

FIELD OF THE INVENTION

The present invention has to with the building design of a container-drum. More specifically, it is a container-drum that has a lid with a circular lip on the surface and guides for fitting fastening belts, as well as handles that facilitate moving the containers.

INVENTION'S BACKGROUND

The container-drum is a packaging and transportation structure, usually in either a cylindrical or octagonal format, with a top and bottom lid. The container-drum is to be used to store, manually or mechanically move, and transport granular, liquid, or viscous materials.

The current art is cardboard or alveolar plastic packaging, steel or plastic drums, and barrels. The packages made out of cardboard or alveolar plastic have the inconvenience of not having the appropriate devices for hoisting and the surface of the lids are flat, which makes the inclination of the packaging and manual movements difficult causing the use of pallets to be necessary. Furthermore, the packages with a cardboard bottom lid become more fragile when exposed to humidity.

Finally, the steel or plastic drums occupy more storage space and the barrels are a form of cardboard packaging and are unsatisfactory for individual handling.

Hence, the technical literature refers to containers that though they partially solve the problem of storing and streamlining the movement of loads, there is still the need to improve the container-drum in order to facilitate the movement as well as be designed with a framework that is appropriate for locking the lid to the body of the container and appropriate guides for the positioning of the fastening belts to the surface of the container.

Thus, the literature considered neither describes nor suggests a container-drum that comes with plastic lids designed with a rolling surface and guides for the fitting of fastening belts as well as transport handles to carry out the manual or mechanical movement of the container nor any such container-drum as described and claimed in this present request.

SUMMARY

Overall, the present invention is of a building design of a container-drum with a lid that has a surface with a circular projection and an orthogonal projection of a rim around the edge of the container-drum's body and this surface has a lower central hub and concentric guides to fit the fastening belts. These concentric guides come off of the central hub, having cavities and spoked reinforcements set in between the guides with a lid including rims on the top surface with a beveled region.

One of the substantiations of the invention is a container-drum and lid with lower parts and higher parts that cause the locking in place of the lids with the container's body and facilitates the handling of the package.

One of the container-drum's characteristics is the holes all the way through on the surface that coincide with the indentations set in on the lid and that allow the locking of the containers body to the lid and this way facilitate the manual movement or with equipment, as well as the hoisting of the packaging by means of some mechanical equipment.

Another characteristic is a lid made with guides that facilitates the passage of the fastening belts.

DETAILED DESCRIPTION OF THE INVENTION

Figure 1:
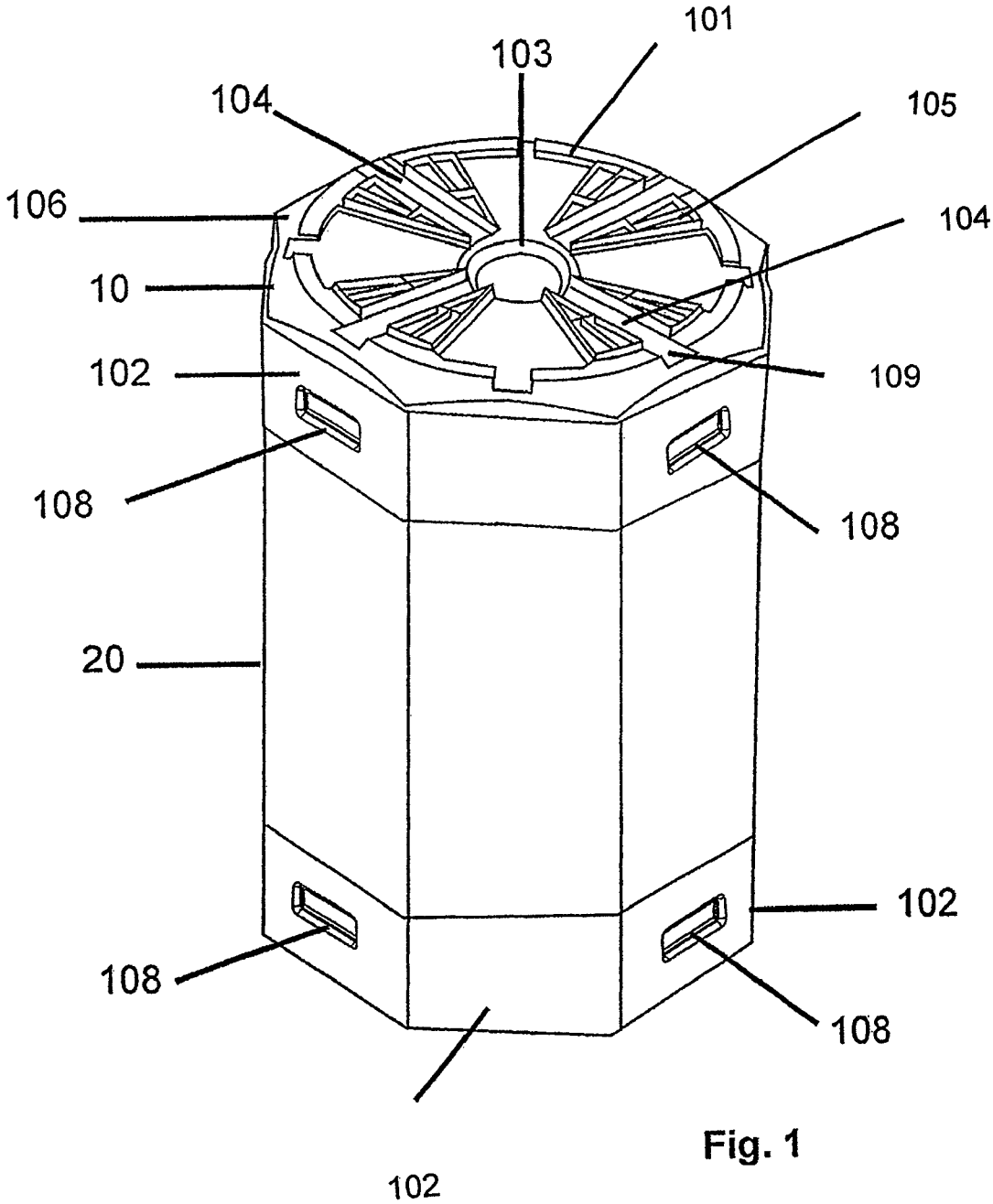
FIG. 1 presents a view in perspective of the container-drum with a lid.
Figure 2:
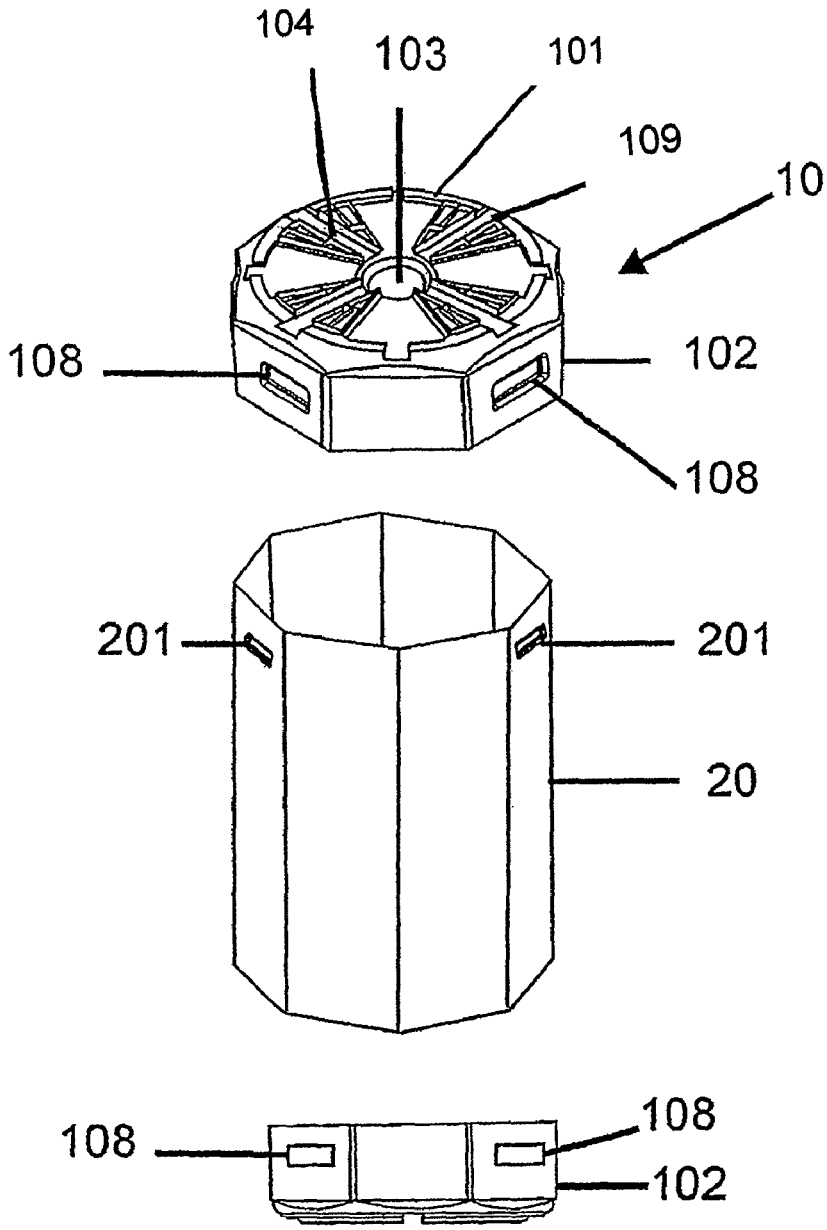
FIG. 2 presents an enlarged view of the container-drum highlighting the body of the container, the top and bottom lids, and the fastening belts.
Figure 3:
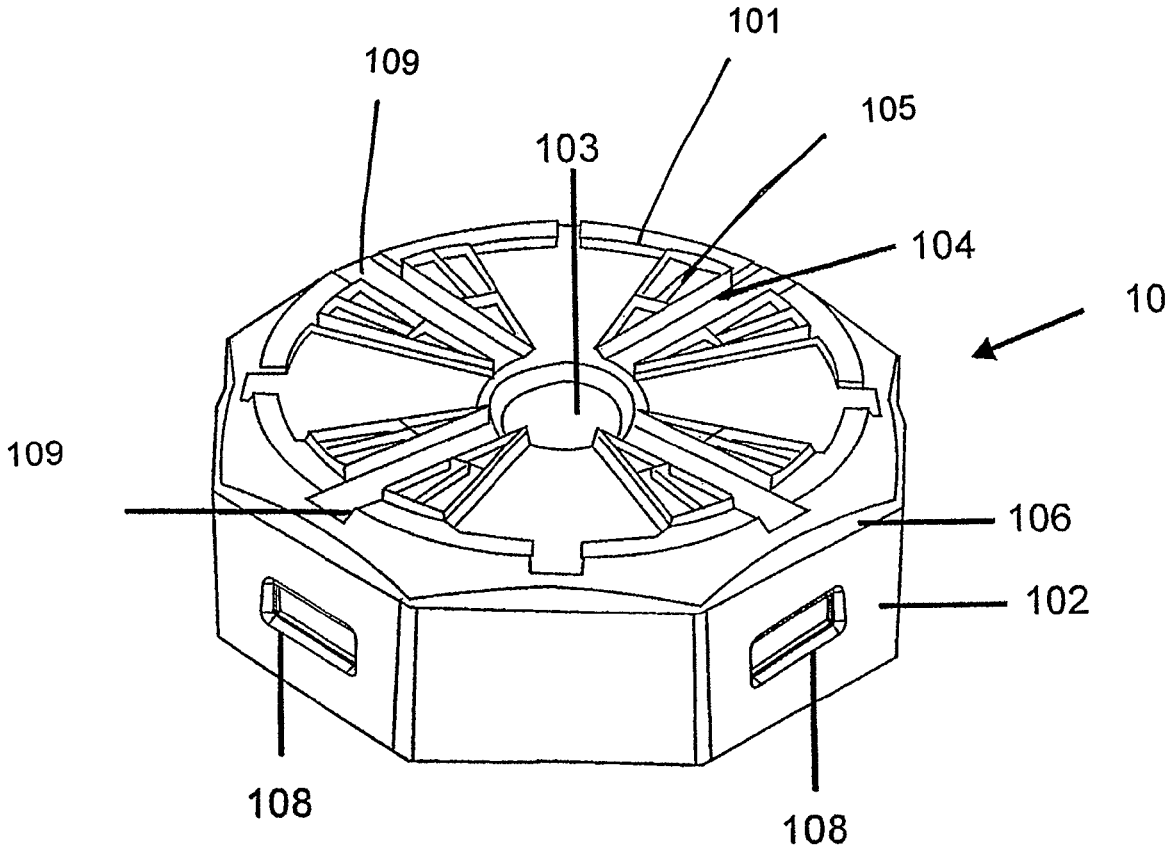
FIG. 3 presents a view in perspective of the lid.
Figure 4:
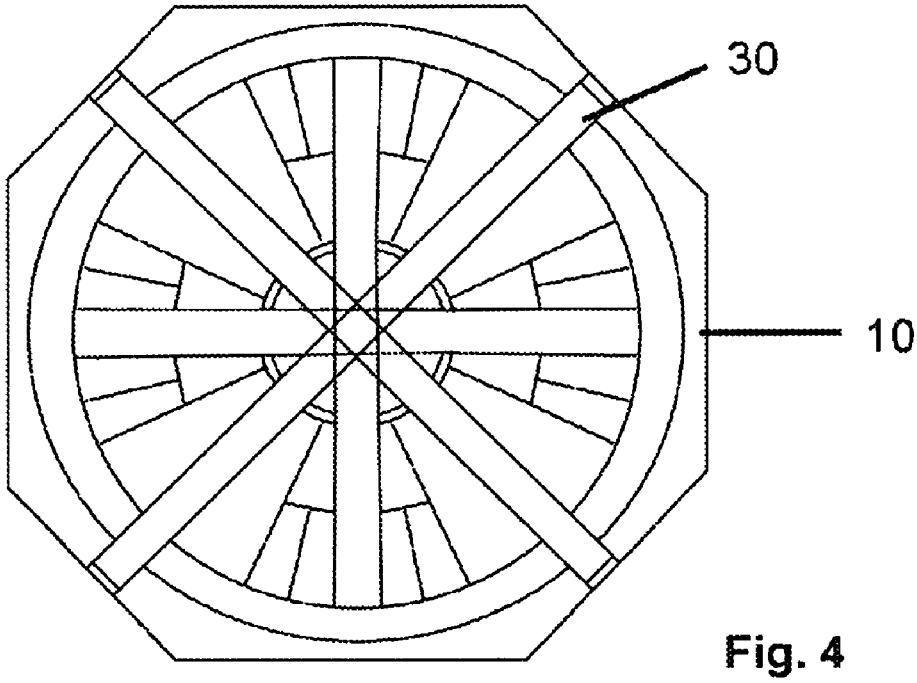
FIG. 4 presents a top view of the lid with the fastening belts positioned in the guides.
Figure 5:
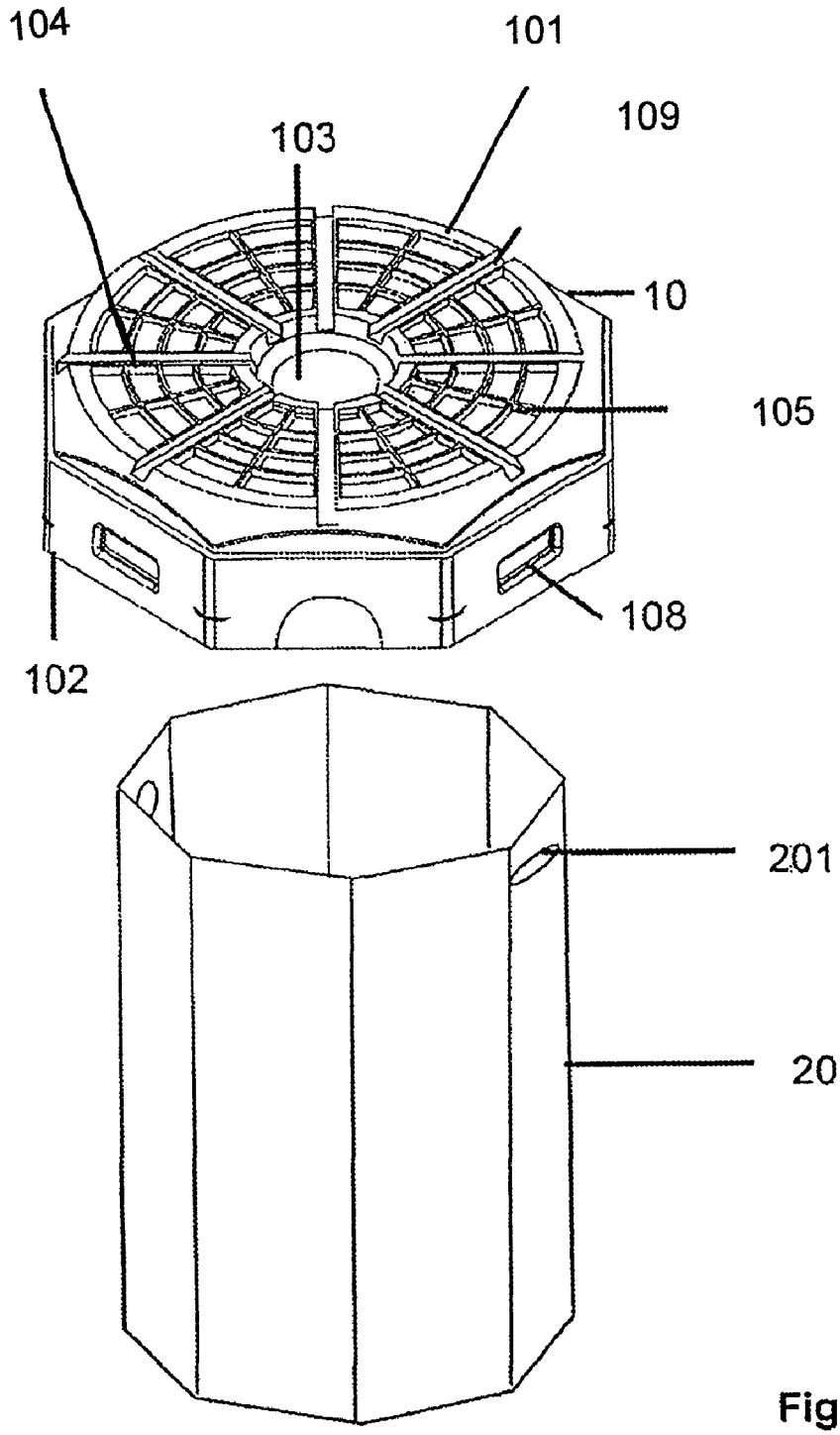
FIG. 5 presents a view in perspective of the design variant of the lid.
Figure 6:
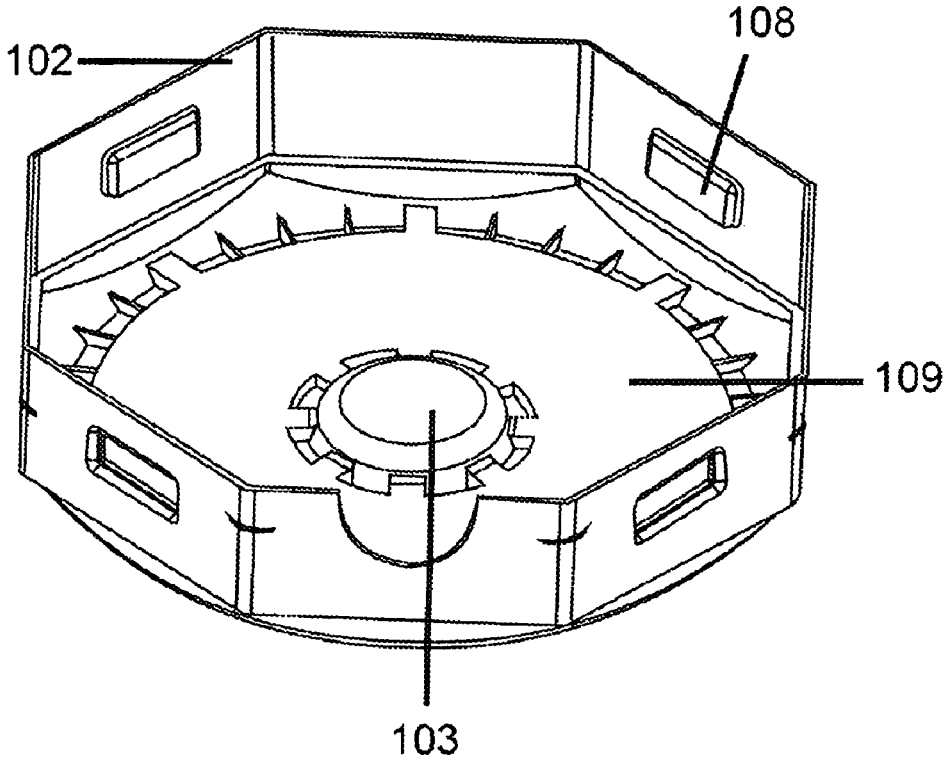
FIG. 6 presents a view of the internal region of the lid's design variant.
Figure 7:
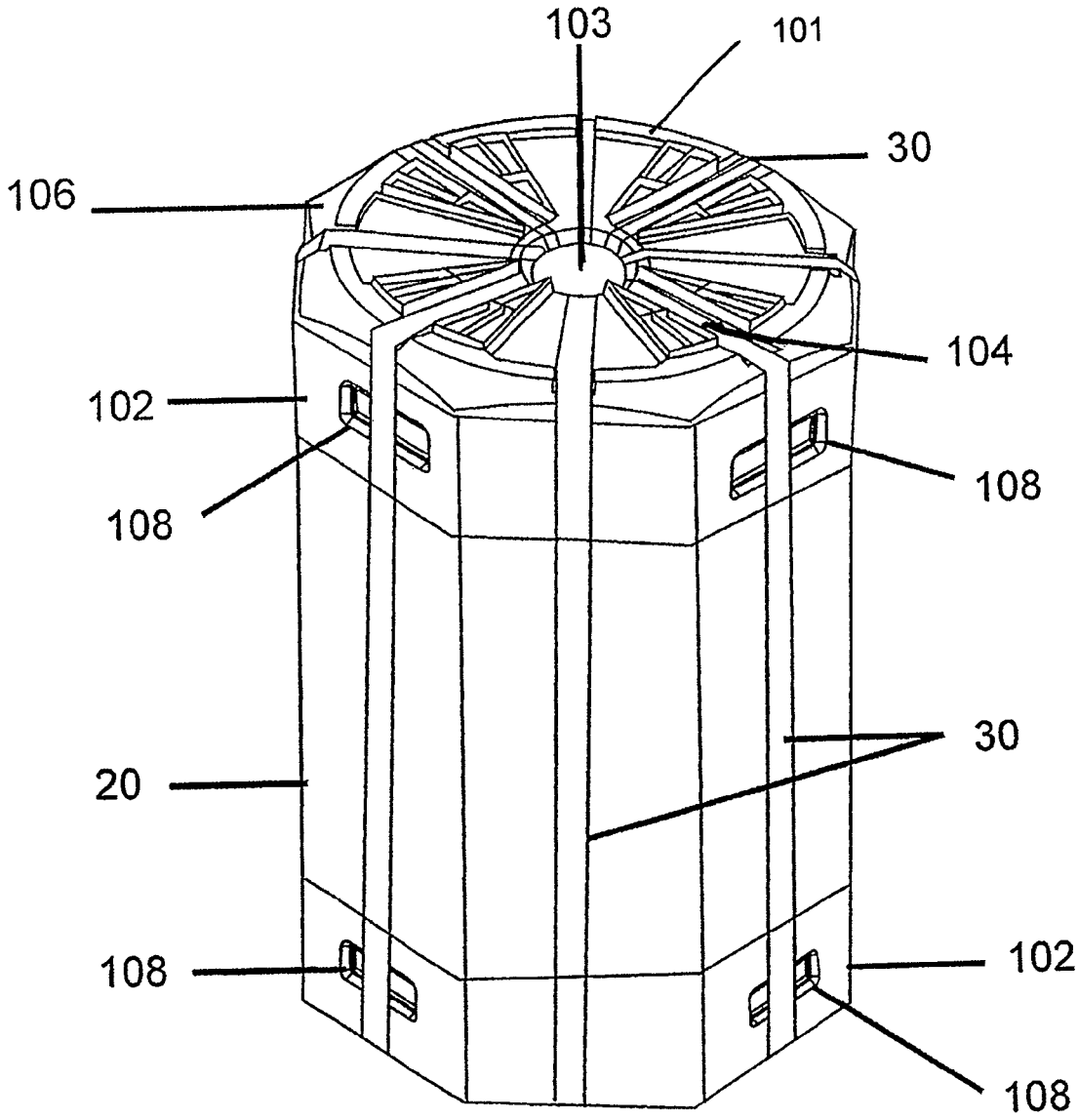
FIG. 7 presents a view in perspective of the container-drum with a lid and fastening belts positioned in the guides.

The building design of a container-drum, which is the object of the present invention, includes a lid (10) positioned at the top and at the base of a container-drum (20), or any such lid (10) that follows the format of the container-drum's body (20), which includes a surface with a circular projection (101) and an orthogonal projection of a rim (102) around the edge of the container-drum's body (20).

The surface of the lid (10) includes a circular projection (101) and, in the central region of the circular projection, a lowered hub (103) whose surface has concentric guides (104) that come off of the central lowered hub (103). Between the guides (104), spoked reinforcements (105) are provided in intervals defined by cavities (109) in the circular projection (101).

Fastening belts (30) are fitted inside the guides (104) of the lid (10), which press the lid (10) to the drum's body (20). The fastening belts (30) are made of a semi-flexible material and put through the guides (104) of the lid (10) and on the surface of the container-drum (20), ensuring the fastening of the lid (10) to the container's body (20).

The edges of the lid's top surface (10) have a beveled region (106) that is part of a rolling surface of the drums.

For the movement of the container, the lowered hub (103) put in the lid's (10) central region allows the hook to be inserted for the suspension of the container-drum.

The indentations (108) are shown in the rim (102) of lid (10) and these indentations coincide with the holes (201) arranged on the container-drum's surface of the body (20). The indentations (108) fit through the container-drum's (20) allowing the lid (10) of the container-drum to lock and are made with handles that facilitate the manual movement or with equipment, as well as the hoisting of the packaging by means of some mechanical equipment.

The lid (10) is designed with a lowered hub (103) and concentric guides (104) arranged according to the lid's surface (10).

The internal face of the lid (10) has a smooth surface (109), which keeps dirt from accumulating.

The invention claimed is:

1. A container drum comprising:

a container-drum body;

a first lid which matches a shape of the body and which is positioned at a top of the body;

a second lid which matches the shape of the body and which is positioned at a bottom of the body;

wherein each of the first and the second lids comprises a surface comprising a circular projection and an orthogonal projection forming a rim which partly covers a top part or a bottom part of the body;

wherein the surface comprises a central lowered hub and guides provided in order to fit fastening belts, and wherein the guides originate from the central lowered hub and are defined by spoked reinforcements between the guides and by cavities in the circular projection.

2. The container drum as claimed in claim 1, wherein the body comprises holes near the top and the bottom of the body that go through a surface of the body, and wherein the rim of each of the first and the second lids comprises indentations which coincide with the holes.

3. The container drum as claimed in claim 1, wherein a periphery of the surface comprises a beveled region which defines a rolling surface of the container. drum.

* * * * *